US011078615B2

(12) United States Patent
Lee et al.

(10) Patent No.: US 11,078,615 B2
(45) Date of Patent: Aug. 3, 2021

(54) LIFTER AND WASHING MACHINE HAVING THE SAME

(71) Applicant: Samsung Electronics Co., Ltd, Suwon-si (KR)

(72) Inventors: Jung Hee Lee, Suwon-si (KR); Jeong Hoon Kang, Seoul (KR); Kwan Woo Hong, Suwon-si (KR); Dae Uk Kang, Suwon-si (KR); Min Sung Kim, Yongin-si (KR); Ju Bum Han, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 83 days.

(21) Appl. No.: 16/323,171

(22) PCT Filed: Jul. 4, 2017

(86) PCT No.: PCT/KR2017/007056
§ 371 (c)(1),
(2) Date: Feb. 4, 2019

(87) PCT Pub. No.: WO2018/026106
PCT Pub. Date: Feb. 8, 2018

(65) Prior Publication Data

US 2019/0177898 A1 Jun. 13, 2019

(30) Foreign Application Priority Data

Aug. 4, 2016 (KR) ..... 10-2016-0099418

(51) Int. Cl.
*D06F 37/06* (2006.01)
*D06F 37/22* (2006.01)
(Continued)

(52) U.S. Cl.
CPC ..... *D06F 37/06* (2013.01); *D06F 37/065* (2013.01); *D06F 37/22* (2013.01); *D06F 37/264* (2013.01); *D06F 39/02* (2013.01); *D06F 39/083* (2013.01)

(58) Field of Classification Search
None
See application file for complete search history.

(56) References Cited

U.S. PATENT DOCUMENTS 9,951,452 B2 4/2018 Kim
2003/0074932 A1* 4/2003 No ..... D06F 37/06 68/58
(Continued)

FOREIGN PATENT DOCUMENTS

KR 10-2005-0045259 A 5/2005
KR 10-0627909 B1 9/2006
(Continued)

OTHER PUBLICATIONS

International Search Report dated Sep. 22, 2017 in connection with International Patent Application No. PCT/KR2017/007056, 2 pages.
(Continued)

*Primary Examiner* — Cristi J Tate-Sims

(57) ABSTRACT

Disclosed are a lifter having an improved structure to improve washing performance and a washing machine having the lifter. The washing machine includes a drum and a lifter coupled to the inside of the drum, wherein the lifter is provided in the form of a closed curve in which a space is formed at a central portion thereof.

8 Claims, 16 Drawing Sheets

(51) Int. Cl.

| | |
|---|---|
| *D06F 39/08* | (2006.01) |
| *D06F 39/02* | (2006.01) |
| *D06F 37/26* | (2006.01) |

(56) References Cited

U.S. PATENT DOCUMENTS

| | | | | |
|---|---|---|---|---|
| 2005/0097927 | A1* | 5/2005 | Kim | D06F 23/06 68/24 |
| 2014/0208810 | A1* | 7/2014 | Zattin | D06F 39/083 68/58 |

FOREIGN PATENT DOCUMENTS

| | | | |
|---|---|---|---|
| KR | 10-2012-0056707 | A | 6/2012 |
| KR | 10-1271062 | B1 | 6/2013 |
| KR | 10-1504093 | B1 | 3/2015 |

OTHER PUBLICATIONS

Written Opinion of the International Searching Authority dated Sep. 22, 2017 in connection with International Patent Application No. PCT/KR2017/007056, 2 pages.

* cited by examiner

LIFTER AND WASHING MACHINE HAVING THE SAME

CROSS-REFERENCE TO RELATED APPLICATIONS

The present application is a 371 National Stage of International Application No. PCT/KR2017/007056 filed on Jul. 4, 2017, which claims the benefit of Korean Patent Application No. 10-2016-0099418 filed on Aug. 4, 2016, the contents of which are incorporated herein by reference.

BACKGROUND

1. Field

The present disclosure relates to a washing machine, and more particularly, to a lifter having an improved structure to improve washing performance and a washing machine having the lifter.

2. Description of Related Art

A washing machine, which is a machine for washing clothes or the like using electric power, generally includes a tub for storing washing water, a drum rotatably installed in the tub, and a motor for rotationally driving the drum.

When the drum is rotated by the motor after laundry and washing water are introduced into the drum, the laundry is rubbed against the drum and the washing water, and the stains and dirt on the laundry are removed.

A plurality of lifters for causing the laundry to rise and fall when the drum rotates so that the laundry is rubbed against the washing water are provided on an inner surface of the drum.

The lifters are formed to be long in an axial direction of the drum so that the laundry may be rolled up and lifted during a washing course.

SUMMARY

It is an aspect of the present disclosure to provide a lifter having an improved structure to improve washing performance and a washing machine having the lifter.

It is another aspect of the present disclosure to provide a lifter having an improved structure to improve water content of laundry and a washing machine having the lifter.

It is another aspect of the present disclosure to provide a washing machine capable of improving workability and economic effect by a lifter that forms a closed curve.

In accordance with an aspect of the present disclosure, a washing machine includes a drum; and a lifter coupled to the inside of the drum, wherein the lifter is provided in the form of a closed curve in which a space is formed at a central portion thereof.

Further, the lifter includes a pair of first portions disposed in an axial direction of the drum and a pair of second portions provided to connect the first portions, and the space is formed by the first portions and the second portions.

Further, an upper surface of the lifter is formed to be inclined with respect to a lower surface of the lifter.

Further, the lifter includes at least one rib to partition the space.

Further, the at least one rib includes a first rib formed in an axial direction of the drum and a second rib formed in a rotation direction of the drum.

Further, the lifter includes any one of a quadrangle shape, a pentagon shape, an ellipse shape, a circular shape, and a shape in which a pair of circles is connected.

Further, the lifter includes at least one first coupling portion provided to be coupled to the drum, and the drum includes at least one second coupling portion provided to correspond to the at least one first coupling portion.

Further, the lifter is coupled to the drum in a sliding manner by the first coupling portion and the second coupling portion.

Further, the lifter includes at least one first fixing portion provided to be fixed to the drum, and the drum includes at least one second fixing portion provided to correspond to the at least one first fixing portion.

In accordance with another aspect of the present disclosure, a washing machine includes a drum in which laundry is accommodated, the drum rotating by receiving a rotational force from a driving source; and a lifter provided on an inner circumferential surface of the drum to move the laundry in the drum, wherein the lifter is formed to be symmetrical to the left and right with respect to a central axis, and includes a space formed at a central portion thereof.

Further, the lifter includes a first portion forming at least a part of the lifter and disposed in an axial direction of the drum, a second portion forming a remainder of the lifter and connected from the first portion, and a space formed by the first portion and the second portion.

Further, the lifter includes at least one rib to partition the space.

Further, the at least one rib includes a first rib formed in the axial direction of the drum and a second rib formed in a rotation direction of the drum.

Further, the lifter includes at least one fixing portion provided to be coupled to the drum.

Further, the lifter includes at least one first coupling portion provided to be coupled to the drum.

Further, the drum includes at least one second coupling portion provided to correspond to the at least one first coupling portion.

Further, an upper surface of the lifter is formed to be inclined with respect to a lower surface of the lifter.

In accordance with another aspect of the present disclosure, a lifter of a washing machine includes a lifter body coupled to the inside of a drum to move laundry and provided in the shape of a closed curve; and a space formed at a central portion of the lifter body.

Further, the lifter body includes any one of a quadrangle shape, a pentagon shape, an ellipse shape, a circular shape, and a shape in which a pair of circles is connected.

Further, the lifter body includes at least one rib to partition the space.

In accordance with an aspect of the present disclosure, the water content of clothes can be improved by a lifter formed in the shape of a closed curve, thereby improving the washing performance.

In accordance with another aspect of the present disclosure, the washing performance can be improved without increasing the assembling time and the number of parts, and the workability can be improved.

DETAILED DESCRIPTION

Hereinafter, embodiments according to the present disclosure will be described in detail with reference to the accompanying drawings. In this specification, the terms "front," "rear," "upper," "lower," "left," and "right" are defined with reference to the drawings, and the shape and position of each component are not limited by these terms.

Figure 1:
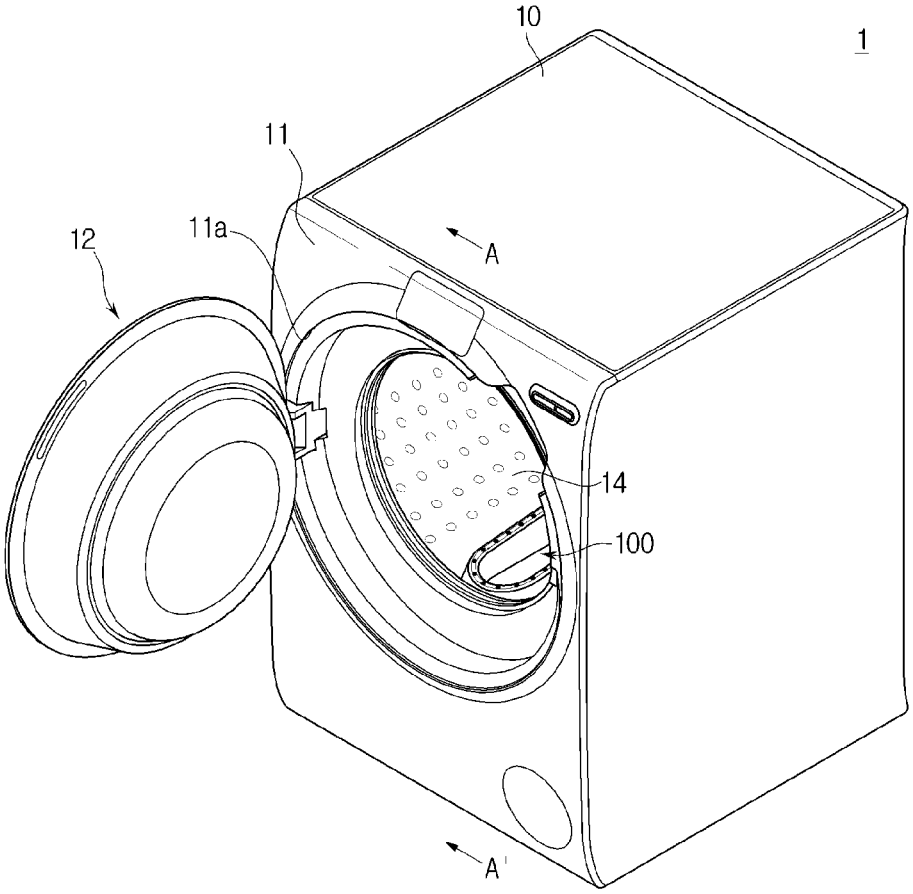
FIG. 1 is a perspective view illustrating a washing machine according to an embodiment of the present disclosure.
Figure 2:
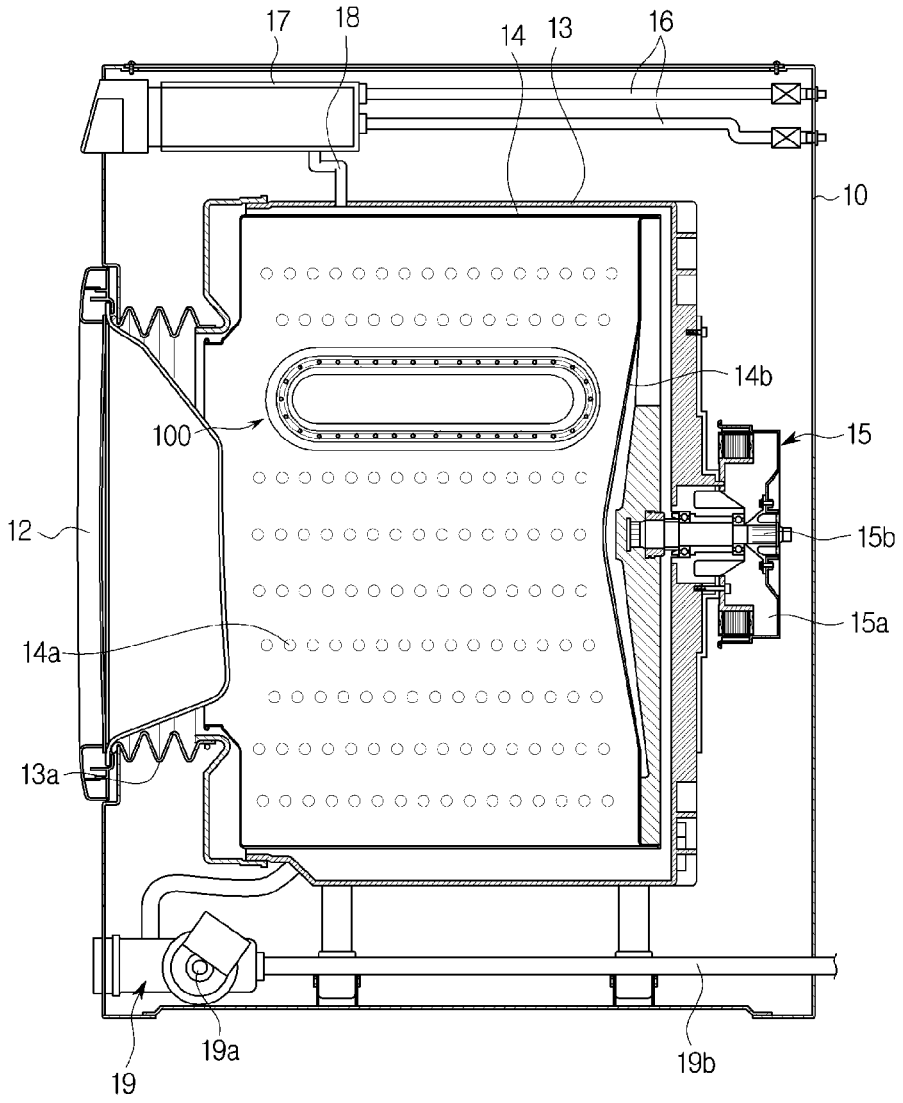
FIG. 2 is a sectional view illustrating a washing machine according to an embodiment of the present disclosure.

FIG. 1 is a perspective view illustrating a washing machine according to an embodiment of the present disclosure, and FIG. 2 is a sectional view illustrating a washing machine according to an embodiment of the present disclosure.

As illustrated in FIGS. 1 and 2, a washing machine 1 includes a cabinet 10 forming an outer appearance, a tub 13 provided inside the cabinet 10, a drum 14 rotatably installed in the tub 13, and a lifter 100 installed on the drum 14 to move laundry.

A front panel 11 of the cabinet 10, which is formed in a hexahedron shape, is provided with a laundry inlet 11*a* through which the laundry is put. The laundry inlet 11*a* is provided with a door 12 for selectively opening and closing the laundry inlet 11*a*. The door 12 is hinged to the laundry inlet 11*a* of the front panel 11 to open and close the laundry inlet 11*a*.

The tub 13 may be installed horizontally or at a predetermined inclination inside the cabinet 10 so that washing water may be stored during washing. A diaphragm 13*a* may be installed between the tub 13 and the laundry inlet 11*a* to prevent leakage of the washing water and to absorb movement and vibration of the tub 13.

Water supply pipes 16 for supplying the washing water to the tub 13 are installed at an upper portion of the tub 13. One side of the water supply pipes 16 may be connected to an external water supply source (not shown), and the other side of the water supply pipes 16 may be connected to a detergent supply device 17.

The detergent supply device 17 is connected to the tub 13 through a connecting pipe 18. The water supplied through the water supply pipes 16 is supplied to the inside of the tub 13 together with a detergent via the detergent supply device 17.

A drain device 19 for discharging the washing water in the tub 13 to the outside of the cabinet 10 is provided below the tub 13. The drain device 19 may include a drain pump 19*a* and a drain hose 19*b*. One side of the drain hose 19*b* may be connected to the drain pump 19*a* and the other side of the drain hose 19*b* may extend outside the cabinet 10.

The drum 14 is rotatably installed inside the tub 13 so that the laundry loaded through the laundry inlet 11*a* may be washed. The drum 14 may include a plurality of holes 14*a* formed in an outer circumferential surface of the drum 14 so that the washing water may flow in and out of the drum 14. The plurality of holes 14*a* formed in the drum 14 allow an inner space of the drum 14 and an inner space of the tub 13 to communicate with each other.

A driving device 15 for rotating the drum 14 is installed on a rear side of the drum 14. The driving device 15 may include a driving motor 15*a*.

A rotating shaft 15*b* is disposed between the drum 14 and the motor 15*a*. One end of the rotating shaft 15*b* is connected to a rear surface of the drum 14 so that when the driving motor 15*a* rotates the rotating shaft 15*b*, the drum 14 connected to the rotating shaft 15*b* is rotated.

The washing machine 1 constructed as described above performs washing and rinsing while the laundry is lifted by the rotation of the drum 14 and falls down by gravity as the drum 14 is rotated by the operation of the driving device 15.

The lifter 100 may be provided on an inner circumferential surface of the drum 14 so that the laundry may be lifted and dropped when the drum 14 rotates. A plurality of the lifters 100 may be provided on the inner circumferential surface of the drum 14 at a predetermined interval.

The lifter 100 is installed so as to protrude toward the inner center of the drum 14. Accordingly, as the drum 14 rotates, the lifter may lift the laundry up to a predetermined height in the drum 14 and may smoothly flow the washing water along with the movement of the laundry, thereby improving the washing effect of the laundry.

Figure 3:
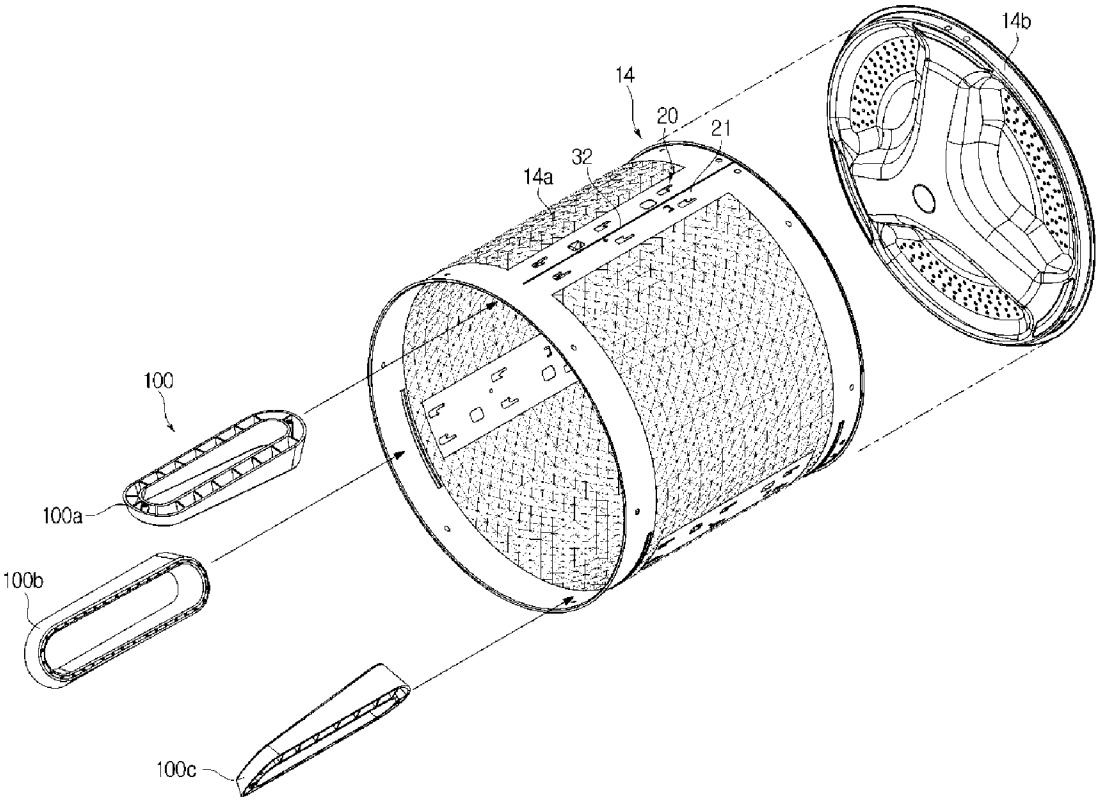
FIG. 3 is an exploded perspective view illustrating a drum and lifters of a washing machine according to an embodiment of the present disclosure.
Figure 4:
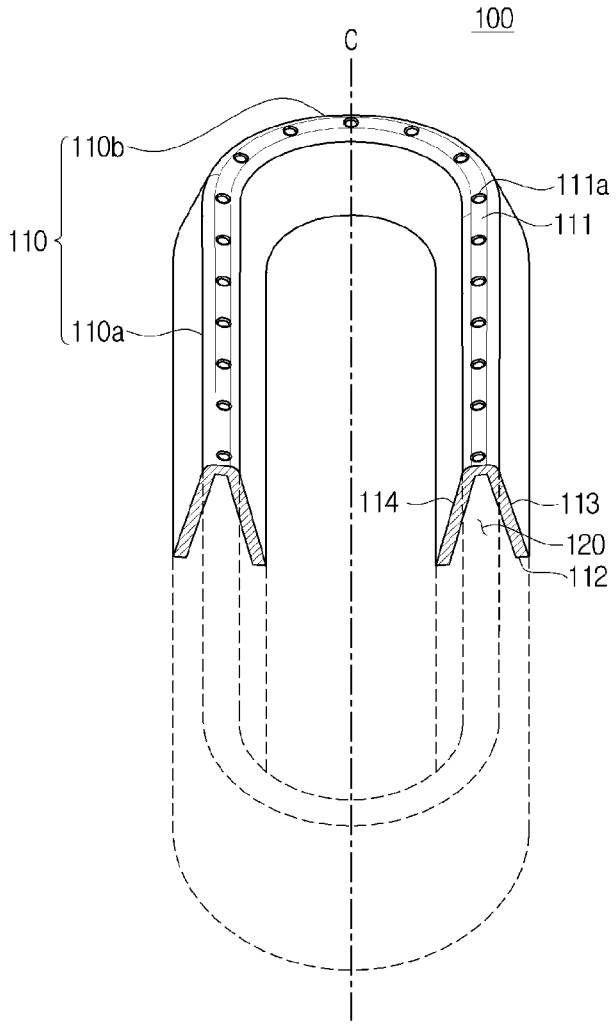
FIG. 4 is a partial sectional view illustrating a lifter according to an embodiment of the present disclosure.
Figure 5:
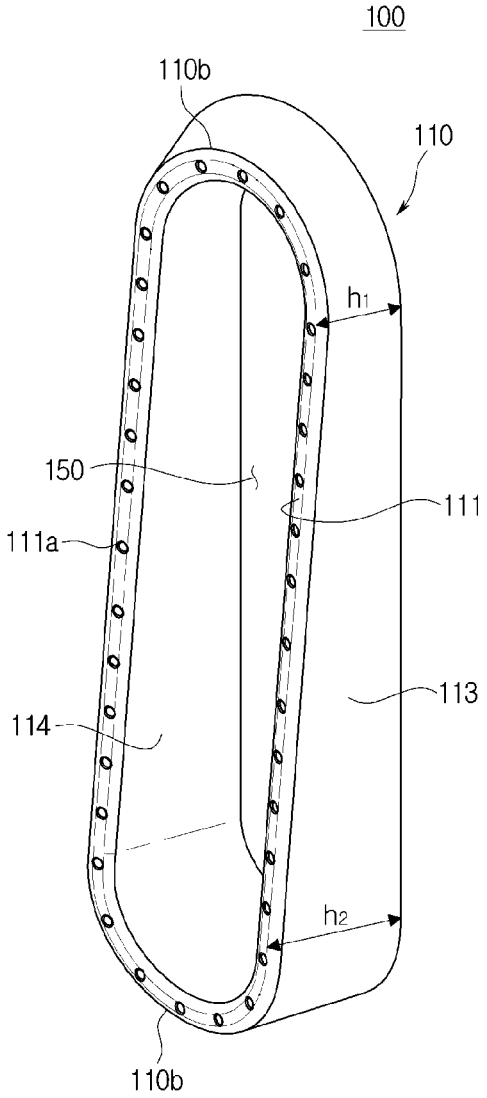
FIG. 5 is a perspective view illustrating a lifter according to an embodiment of the present disclosure.
Figure 6:
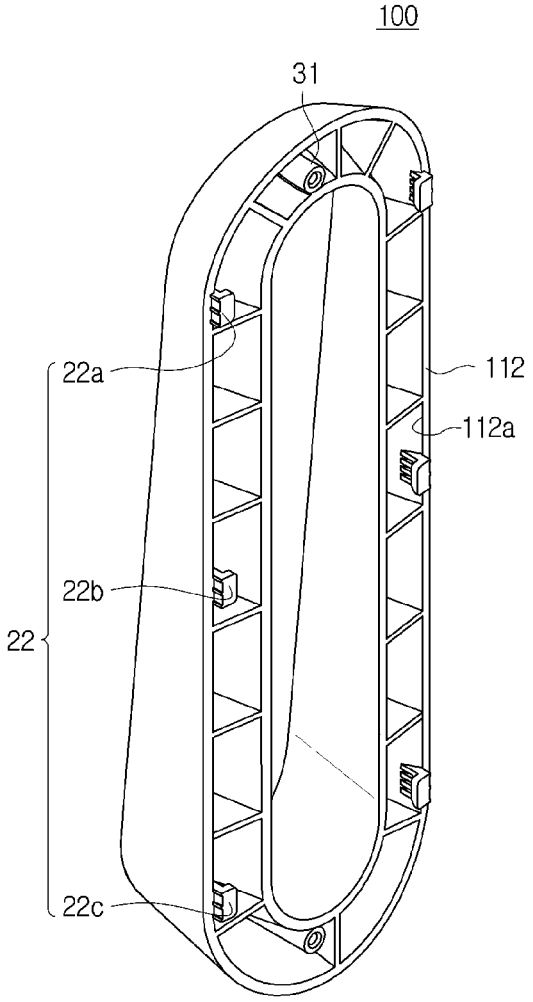
FIG. 6 is a rear view illustrating a lifter according to an embodiment of the present disclosure.
Figure 7:
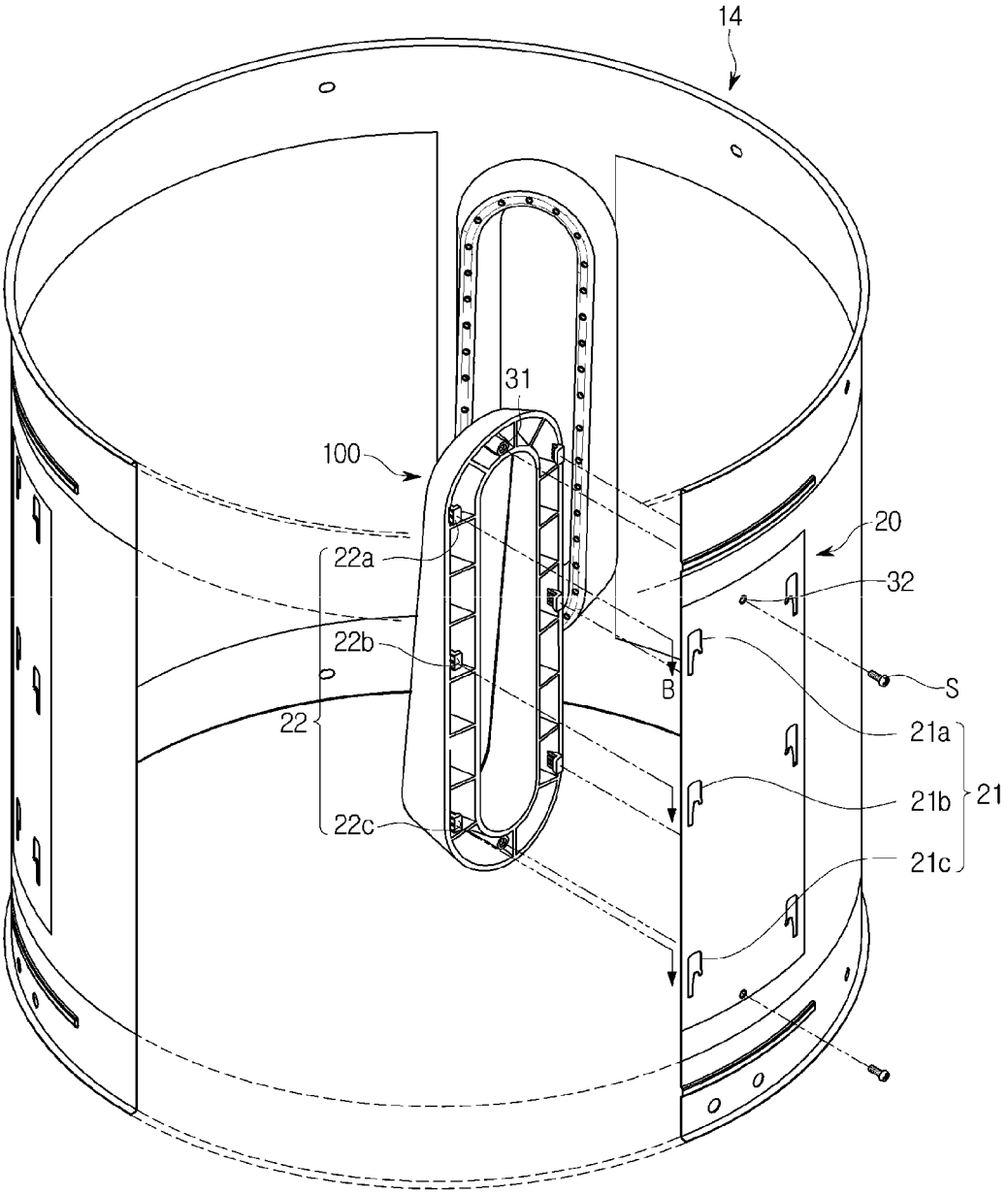
FIG. 7 is a perspective view illustrating a coupling structure of a lifter and a drum according to an embodiment of the present disclosure.
Figure 8:
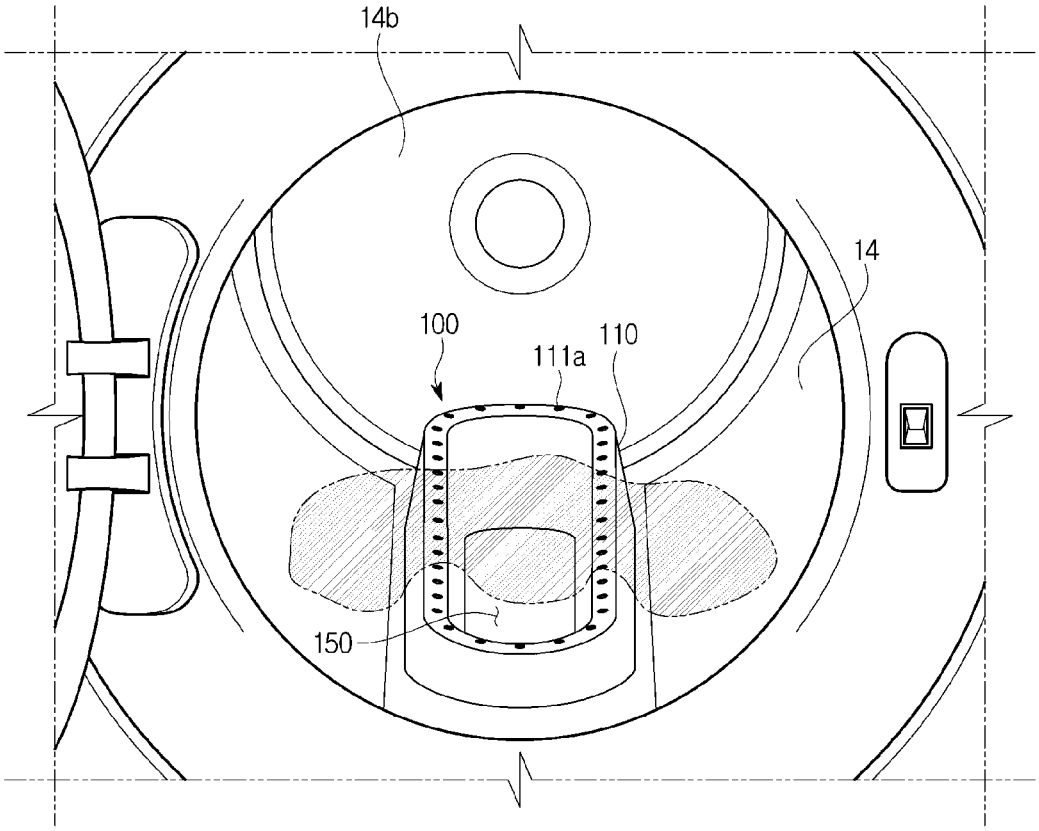
FIG. 8 is a view illustrating a state in which a lifter according to an embodiment of the present disclosure is mounted on a drum.

FIG. 3 is an exploded perspective view illustrating a drum and lifters of a washing machine according to an embodiment of the present disclosure, FIG. 4 is a partial sectional view illustrating a lifter according to an embodiment of the present disclosure, FIG. 5 is a perspective view illustrating a lifter according to an embodiment of the present disclosure, FIG. 6 is a rear view illustrating a lifter according to an embodiment of the present disclosure, FIG. 7 is a perspective view illustrating a coupling structure of a lifter and a drum according to an embodiment of the present disclosure, and FIG. 8 is a view illustrating a state in which a lifter according to an embodiment of the present disclosure is mounted on a drum.

As illustrated in FIGS. 3 to 8, the lifter 100 may be provided on the inner circumferential surface of the drum 14.

A plurality of the lifters 100 may be disposed on the inner circumferential surface of the drum 14 at the predetermined interval. The lifters 100 may include a first lifter 100*a*, a second lifter 100*b*, and a third lifter 100*c*. The first lifter 100*a* to the third lifter 100*c* may be installed on the cylindrical drum 14 at intervals of 120 degrees. In the embodiment of the present disclosure, three of the lifters 100 are provided, but the present disclosure is not limited thereto. For example, the number of lifters may be less or more than three.

The drum 14 is provided with a lifter mounting portion 20 for mounting the lifter 100 thereon. The lifter mounting portion 20 is provided so as to correspond to the lifter 100. In the embodiment of the present disclosure, three of the lifter mounting portions 20 are formed to correspond to the lifters 100, but the present disclosure is not limited thereto. The number of the lifter mounting portions 20 of the drum 14 may be changed according to the number of the lifters 100.

The lifter 100 may include a lifter body 110 forming an outer shape, and a first coupling portion 22 and a first fixing portion 31 that are provided to allow the lifter body 110 to be installed to the drum 14.

The lifter body 110 is formed to be symmetrical about a central axis C and a space 150 is formed at a central portion of the lifter body 110. That is, the lifter body 110 is formed in the shape of a closed curve so that the space 150 is formed at the central portion. The lifter body 110 may be formed in a substantially elliptic shape.

The lifter body 110 includes an outer side surface 113 and an inner side surface 114, an upper surface 111 and a lower surface 112 connecting the outer side surface 113 and the inner side surface 114, and a washing water receiving portion 120 formed by the outer side surface 113 and the inner side surface 114. When the lifter body 110 is coupled to the drum 14, a predetermined space in which the washing water may be stored is formed between the lifter body 110 and the inner circumferential surface of the drum 14. The washing water receiving portion 120 is provided by the predetermined space formed between the lifter body 110 and the inner circumferential surface of the drum 14 so that the washing water may be stored.

The washing water receiving portion 120 may be formed by the outer side surface 113, the inner side surface 114 and the upper surface 111 of the lifter body 110 and the inner circumferential surface of the drum 14.

The lower surface 112 of the lifter body 110 is provided with inlet hole 112*a* for allowing the washing water to flow from the outside of the drum 14. The inlet hole 112*a* may be formed by lower edges of the inner side surface 114 and the outer side surface 113 of the lifter body 110.

The upper surface 111 of the lifter body 110 may be formed to have a smaller width than the lower surface 112 of the lifter body 110. Accordingly, a section of the lifter body 110 may have a substantially 'A' shape or a trapezoid shape.

A plurality of injection holes 111*a* are formed on the upper surface 111 of the lifter body 110. The plurality of injection holes 111*a* are spaced apart from the upper surface 111 of the lifter body 110 by a predetermined interval. The plurality of injection holes 111*a* are communicated with the washing water receiving portion 120 so that the washing water stored in the washing water receiving portion 120 may flow in or out through the injection holes 111*a* of the upper surface 111.

The lifter body 110 rotates together with the drum 14 to lift the laundry. The lifter body 110 includes a pair of first portions 110*a* disposed in an axial direction, and a pair of second portions 110*b* extending from the respective first portions 110*a* and connecting the pair of first portions 110*a*. The lifter body 110 forms a closed curve by the first portions 110*a* and the second portions 110*b* of the lifter body 110. The first portions 110*a* of the lifter body 110 may be disposed to be spaced apart from each other by a predetermined distance. The second portions 110*b* are provided to connect the opposite ends of the first portions 110*a*. The second portions 110*b* may be formed in a circular shape and may have a curvature.

The upper surface 111 of the lifter body 110 may be formed to be inclined with respect to the lower surface 112. A first height h1 of one side of the first portion 110*a* of the lifter body 110 may be lower than a second height h2 of the other side of the first portion 110*a*. Although the first height h1 of the lifter body 110 is lower than the second height h2 of the lifter body 110 in the embodiment of the present disclosure, the concept of the present disclosure is not limited thereto. For example, the first height may be higher than the second height.

The lower surface 112 of the lifter body 110 is provided with the first coupling portion 22 for coupling with the drum 14. The first coupling portion 22 may be disposed on the left and right sides of the lower surface 112 of the lifter body 110, respectively. At least one pair of the first coupling portions 22 may be provided. The first coupling portion 22 may include a first coupling protrusion 22*a*, a second coupling protrusion 22*b*, and a third coupling protrusion 22*c*. The first coupling protrusion 22*a*, the second coupling protrusion 22*b*, and the third coupling protrusion 22*c* protrude downward from the lower surface 112 and are coupled to the drum 14.

The first coupling protrusion 22*a*, the second coupling protrusion 22*b*, and the third coupling protrusion 22*c* may protrude in the direction of the central axis C of the lifter body 110 and be coupled to the drum 14. Although the ends of the first coupling protrusion 22*a*, the second coupling protrusion 22*b*, and the third coupling protrusion 22*c* are formed to be bent in the center direction of the lifter body 110 in the embodiment of the present disclosure, the concept of the present disclosure is not limited thereto. For example, the ends of the first coupling protrusion 22*a*, the second coupling protrusion 22*b*, and the third coupling protrusion 22*c* may be formed to protrude outwardly from the periphery of the drum 14.

The drum 14 is provided with a second coupling portion 21 corresponding to the first coupling portion 22 so that the lifter body 110 may be coupled to the drum 14. At least one pair of the second coupling portions 21 may be provided. The second coupling portion 21 may include a first coupling hole 21*a*, a second coupling hole 21*b*, and a third coupling hole 21*c*. The first coupling hole 21*a*, the second coupling hole 21*b*, and the third coupling hole 21*c* may be formed at positions corresponding to the first coupling protrusion 22*a*, the second coupling protrusion 22*b*, and the third coupling protrusion 22*c*, respectively.

The first coupling hole 21*a*, the second coupling hole 21*b*, and the third coupling hole 21*c* may be formed in a substantially '-1' shape. The first coupling hole 21*a*, the second coupling hole 21*b*, and the third coupling hole 21*c* may be formed in an axial direction of the drum 14.

As illustrated in FIG. 7, the lifter body 110 may be coupled to the drum 14 in a sliding manner by inserting the first coupling portion 22 into the second coupling portion 21 of the drum 14.

The first coupling protrusion 22*a*, the second coupling protrusion 22*b*, and the third coupling protrusion 22*c* of the lifter body 110 are inserted into the first coupling hole 21*a*, the second coupling hole 21*b*, and the third coupling hole 21*c* of the drum 14, respectively, so that lifter body 110 may be firmly coupled to the drum 14 so as not to be separated by moving in the axial direction of the drum 14.

The lifter body 110 may include the at least one first fixing portion 31 provided to be fixed to the drum 14. The first fixing part 31 may be formed on one side and the other side of the lower surface 112 of the lifter body 110. The first fixing portion 31 is provided so as to be fixed by a fastening member such as a screw S or the like.

A second fixing portion 32 corresponding to the first fixing portion 31 is formed on the lifter mounting portion 20 of the drum 14. The second fixing portion 32 may include a hole formed so that the screw S may be inserted therethrough.

Accordingly, the lifter body 110 may be provisionally assembled to the drum 14 by inserting the first coupling protrusion 22*a*, the second coupling protrusion 22*b*, and the third coupling protrusion 22*c* of the lifter body 110 into the first coupling hole 21*a*, the second coupling hole 21*b*, and the third coupling hole 21*c* of the drum 14, respectively, and then axially sliding the first coupling protrusion 22*a*, the second coupling protrusion 22*b*, and the third coupling protrusion 22*c*.

The lifter body 110 provisionally assembled to the drum 14 may be fixed to the drum 14 by fastening the first fixing portion 31 of the lifter body 110 to the second fixing portion 32 of the drum 14 with the screw S.

The lifter body 110 forming a closed curve, which is fixed to the drum 14 as described above, may lift the laundry by using the first portions 110*a* formed in the axial direction of the drum 14 when the drum 14 rotates. The first portions 110*a* of the lifter body 110 are arranged to be symmetrical about the central axis C and the laundry may be accommodated and lifted in the space 150, which is formed at a central portion of the first portions 110*a*, thereby improving the efficiency of the lifter 100.

Figure 9:
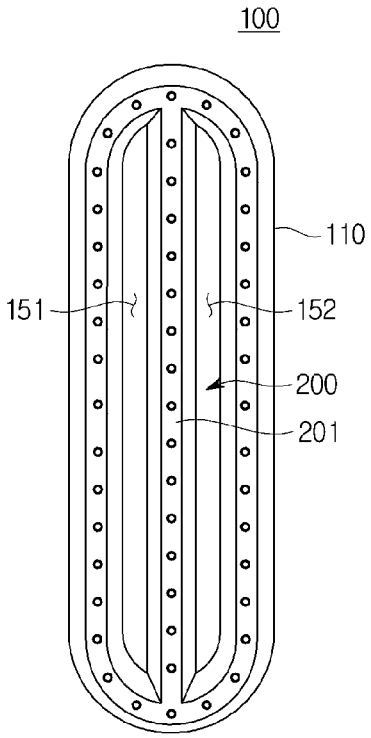
FIG. 9 is a view illustrating a lifter according to a second embodiment of the present disclosure.
Figure 10:
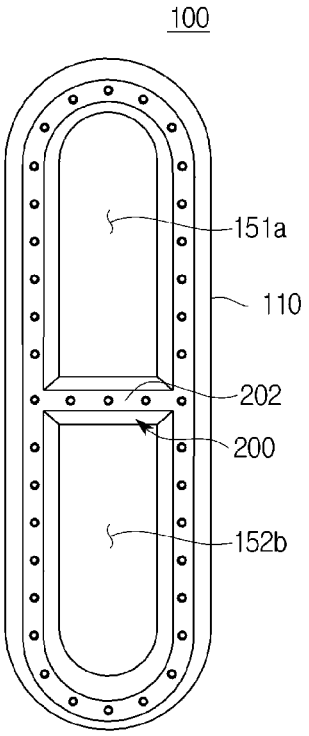
FIG. 10 is a view illustrating a lifter according to a third embodiment of the present disclosure.

FIG. 9 is a view illustrating a lifter according to a second embodiment of the present disclosure, and FIG. 10 is a view illustrating a lifter according to a third embodiment of the present disclosure. Reference numerals not shown in FIGS. 9 and 10 will refer to those shown in FIGS. 1 to 8.

As illustrated in FIGS. 9 and 10, the lifter 100 includes a rib 200 to partition the space 150.

The lifter body 110 of the lifter 100 may be formed in a substantially elliptic shape. The lifter body 110 may include a first rib 201 formed in the axial direction of the drum 14. The first rib 201 may be provided to partition the space 150 of the lifter body 110. The first rib 201 may be formed long in the longitudinal direction at the center of the space 150 of the lifter body 110. The first rib 201 is provided to partition the space 150 of the lifter body 110 into a first space 151 and a second space 152.

When the drum 14 rotates, the lifter 100 may lift the laundry through the first portions 110*a*, the first space 151, and the second space 152 of the lifter body 110, thereby increasing the washing and dehydrating efficiency.

The lifter body 110 may further include a second rib 202 formed in a rotating direction of the drum 14.

The second rib 202 may be provided to partition the space 150 of the lifter body 110. The second ribs 202 may be formed in the width direction at the center of the space 150 of the lifter body 110. The second rib 202 is provided to partition the space 150 of the lifter body 110 into a first space 151*a* and a second space 152*a*.

Figure 11:
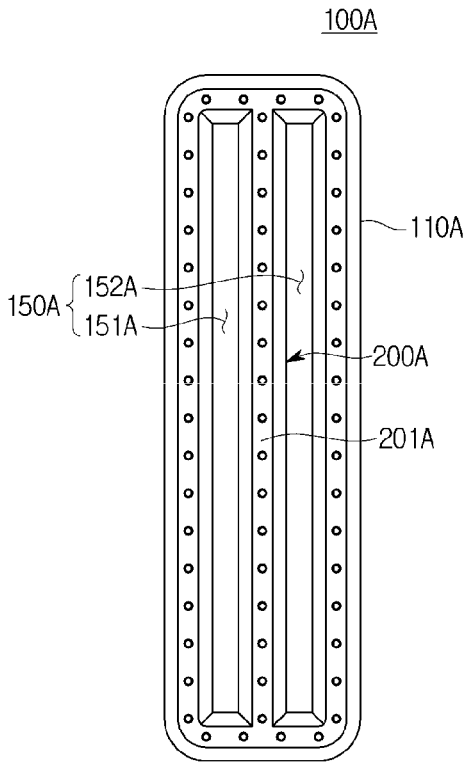
FIG. 11 is a view illustrating a lifter according to a fourth embodiment of the present disclosure.
Figure 12:
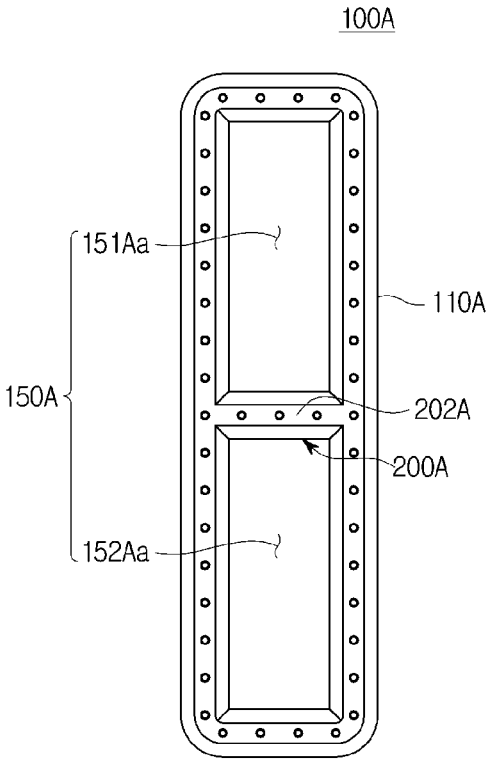
FIG. 12 is a view illustrating a lifter according to a fifth embodiment of the present disclosure.

FIG. 11 is a view illustrating a lifter according to a fourth embodiment of the present disclosure, and FIG. 12 is a view illustrating a lifter according to a fifth embodiment of the present disclosure. Reference numerals not shown in FIGS. 11 and 12 will refer to those shown in FIGS. 1 to 8.

As illustrated in FIGS. 11 and 12, a lifter 100A includes a rib 200A to partition a space 150A.

A lifter body 110A of the lifter 100A may be formed in a rectangular shape. The lifter body 110A may include a first rib 201A formed in the axial direction of the drum 14. The first rib 201A may be provided to partition the space 150A of the lifter body 110A. The first rib 201A may be formed long in the longitudinal direction at the center of the space 150A of the lifter body 110A. The first rib 201A is provided to partition the space 150A of the lifter body 110A into a first space 151A and a second space 152A.

When the drum 14 rotates, the lifter 100A may lift the laundry through the first portions 110*a*, the first space 151A, and the second space 152A of the lifter body 110A, thereby increasing the washing and dehydrating efficiency.

The lifter body 110A may further include a second rib 202A formed in the rotating direction of the drum 14.

The second rib 202A may be provided to partition the space 150A of the lifter body 110A. The second ribs 202A may be formed in the width direction at the center of the space 150A of the lifter body 110A. The second rib 202A is provided to partition the space 150A of the lifter body 110A into a first space 151A and a second space 152A.

Figure 13:
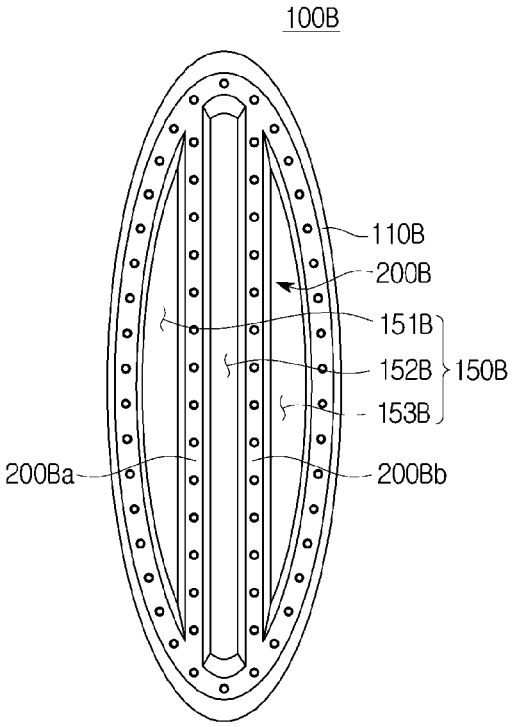
FIG. 13 is a view illustrating a lifter according to a sixth embodiment of the present disclosure.
Figure 14:
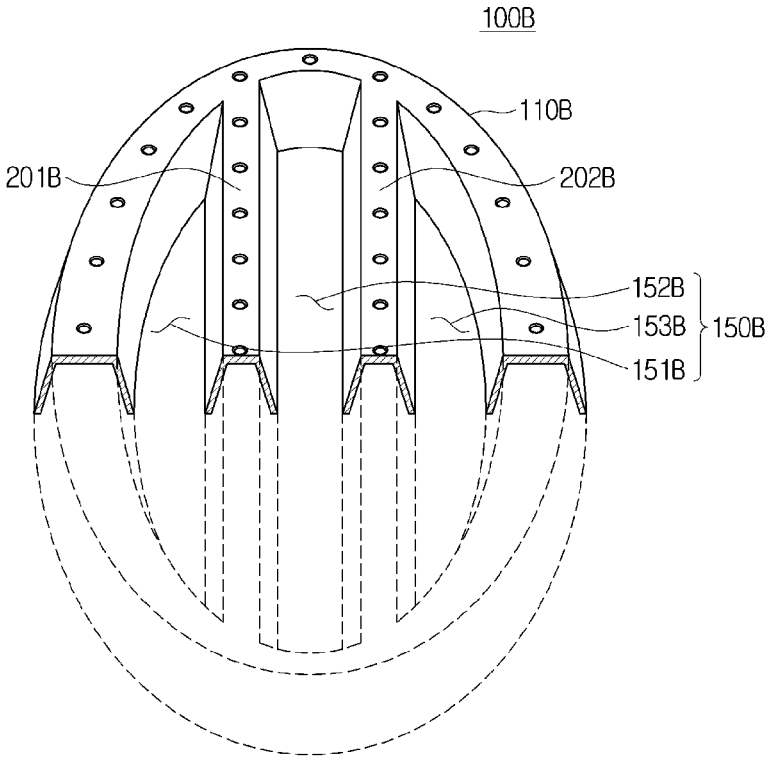
FIG. 14 is a view illustrating a lifter according to a seventh embodiment of the present disclosure.
Figure 15:
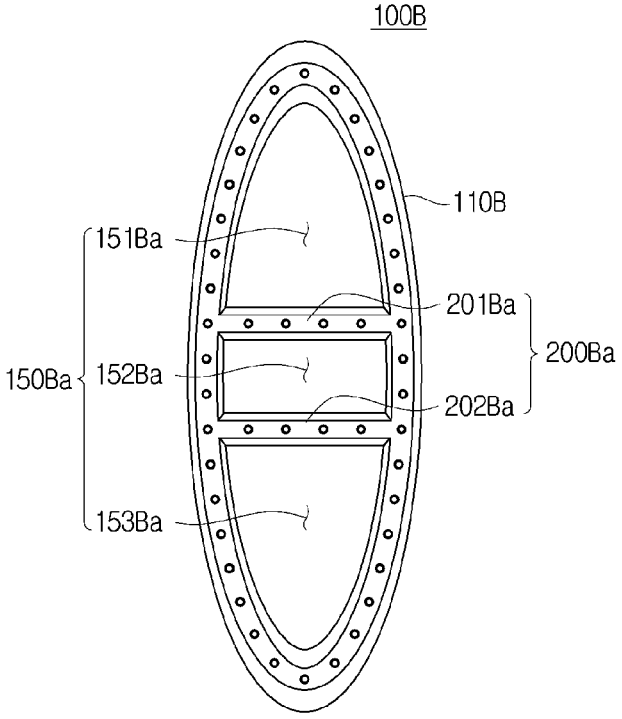
FIG. 15 is a view illustrating a lifter according to an eighth embodiment of the present disclosure.

FIG. 13 is a view illustrating a lifter according to a sixth embodiment of the present disclosure, FIG. 14 is a view illustrating a lifter according to a seventh embodiment of the present disclosure, and FIG. 15 is a view illustrating a lifter according to an eighth embodiment of the present disclosure. Reference numerals not shown in FIGS. 13 to 15 will refer to those shown in FIGS. 1 to 8.

As illustrated in FIGS. 13 to 15, a lifter 100B includes a rib 200B to partition a space 150B.

A lifter body 110B of the lifter 100B may be formed in a substantially elliptic shape. The lifter body 110B may include a plurality of first ribs 201B and 202B formed in the axial direction of the drum 14. The plurality of first ribs 201B and 202B may be provided to partition the space 150B of the lifter body 110B. The plurality of first ribs 201B and 202B may be formed long in the longitudinal direction at the space 150B of the lifter body 110B. The plurality of first ribs 201B and 202B are provided to partition the space 150B of the lifter body 110B into a first space 151B, a second space 152B, and a third space 153B.

When the drum 14 rotates, the lifter 100B may lift the laundry through the first space 151B, the second space 152B, and the third space 153B of the lifter body 110B, thereby increasing the washing and dehydrating efficiency. Herein, the section of the lifter body 110B may include a triangular, trapezoidal, or rectangular shape.

The lifter body 110B may further include a plurality of second rib 201Ba and 202Ba formed in the rotating direction of the drum 14.

The plurality of second rib 201Ba and 202Ba may be provided to partition the space 150B of the lifter body 110B. The plurality of second rib 201Ba and 202Ba may be formed in the width direction at the space 150B of the lifter body 110B. The plurality of second rib 201Ba and 202Ba are provided to partition the space 150B of the lifter body 110B into a first space 151Ba, a second space 152Ba, and a third space 153Ba. Although two of the first ribs and two of the second ribs are provided in the space of the lifter body in the embodiments of the present disclosure, the concept of the present disclosure is not limited thereto. For example, a plurality of the first ribs and a plurality of the second ribs may be provided in the space of the lifter body.

Figure 16:
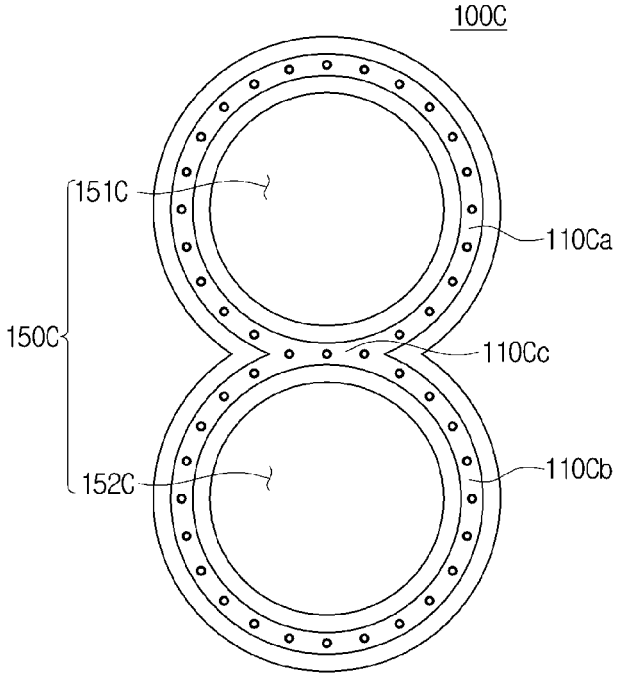
FIG. 16 is a view illustrating a lifter according to a ninth embodiment of the present disclosure.

FIG. 16 is a view illustrating a lifter according to a ninth embodiment of the present disclosure. Reference numerals not shown in FIG. 16 will refer to those shown in FIGS. 1 to 8.

As illustrated in FIG. 16, a lifter body 110C of a lifter 100C may be formed in a circular shape.

The lifter body 110C may include a first body 110Ca and a second body 110Cb, which are formed in a circular shape, and a connection portion 110Cc for connecting the first body 110Ca and the second body 110Cb.

The first body 110Ca and the second body 110Cb may be formed in corresponding sizes and shapes. The first body 110Ca and the second body 110Cb are formed in the shape of a closed curve.

A first space 151C may be formed in the first body 110Ca and a second space 152C may be formed in the second body 110Cb. When the drum 14 rotates, the lifter 100C may lift the laundry through the first body 110Ca, the second body 110Cb, the first space 151C and the second space 152C of the lifter body 110C, thereby increasing the washing and dehydrating efficiency.

The foregoing is intended to illustrate and explain the preferred embodiments of the present disclosure. However, it is possible to make changes or modifications within the scope of the concept of the above-described disclosure, within an equivalent scope to the above-described disclosure, and/or within the skill or knowledge of the art.

The invention claimed is:

1. A washing machine comprising:

a drum;

a lifter coupled to the inside of the drum; and a plurality of injection holes formed on the lifter to spray washing water into the drum, wherein the lifter is provided in a form of a closed curve with an opening toward an interior space of the drum to have a space at a center portion thereof, and wherein the lifter includes a pair of first portions extending in an axial direction of the drum and spaced apart from each other, and a pair of second portions connected to each of the first portions and having a curvature to form the closed curve with the opening.

2. The washing machine according to claim 1, wherein an upper surface of the lifter is formed to be inclined with respect to a lower surface of the lifter.

3. The washing machine according to claim 1, wherein the lifter includes at least one rib to partition the space.

4. The washing machine according to claim 3, wherein the at least one rib includes a first rib formed in an axial direction of the drum and a second rib formed in a rotation direction of the drum.

5. The washing machine according to claim 1, wherein the lifter includes any one of a quadrangle shape, a pentagon shape, an ellipse shape, a circular shape, and a shape in which a pair of circles is connected.

6. The washing machine according to claim 1, wherein:

the lifter includes at least one first coupling portion provided to be coupled to the drum, and the drum includes at least one second coupling portion provided to correspond to the at least one first coupling portion.

7. The washing machine according to claim 6, wherein the lifter is coupled to the drum in a sliding manner by the first coupling portion and the second coupling portion.

8. The washing machine according to claim 1, wherein:

the lifter includes at least one first fixing portion provided to be fixed to the drum, and the drum includes at least one second fixing portion provided to correspond to the at least one first fixing portion.

* * * * *